US009007167B2

(12) United States Patent
Takenaka et al.

(10) Patent No.: US 9,007,167 B2
(45) Date of Patent: Apr. 14, 2015

(54) NON-LINEAR RESISTIVE ELEMENT

(71) Applicant: Otowa Electric Co., Ltd., Osaka-shi, Osaka (JP)

(72) Inventors: Shinsuke Takenaka, Amagasaki (JP); Toshihiko Suzuki, Amagasaki (JP); Naoyuki Tsukamoto, Amagasaki (JP)

(73) Assignee: Otowa Electric Co., Ltd., Osaka-Shi (JP)

( * ) Notice: Subject to any disclaimer, the term of this patent is extended or adjusted under 35 U.S.C. 154(b) by 0 days.

(21) Appl. No.: 14/119,984

(22) PCT Filed: Mar. 28, 2013

(86) PCT No.: PCT/JP2013/059244
§ 371 (c)(1),
(2) Date: Nov. 25, 2013

(87) PCT Pub. No.: WO2013/150952
PCT Pub. Date: Oct. 10, 2013

(65) Prior Publication Data

US 2014/0125449 A1 May 8, 2014

(30) Foreign Application Priority Data

Apr. 4, 2012 (JP) ..... 2012-085965

(51) Int. Cl.
*H01C 3/00* (2006.01)
*H01C 7/00* (2006.01)
*H01C 13/00* (2006.01)

(Continued)

(52) U.S. Cl.
CPC ..... *H01C 13/00* (2013.01); *H01C 7/1006* (2013.01); *H01C 7/102* (2013.01); *H01C 7/112* (2013.01)

(58) Field of Classification Search
CPC ..... H01C 7/10; H01C 7/12; H01C 7/1006; H01C 7/102; H01C 7/112; H01C 13/00
USPC ..... 338/22 R, 333, 210, 296, 211, 287
See application file for complete search history.

(56) References Cited

U.S. PATENT DOCUMENTS 3,210,831 A * 10/1965 Lawrence et al. ..... 29/621
3,727,165 A * 4/1973 Hagen ..... 338/20

(Continued)

FOREIGN PATENT DOCUMENTS

EP 2704158 3/2014
JP S62-287584 12/1987

(Continued)

OTHER PUBLICATIONS

European Search Report dated Sep. 5, 2014, 7 pages.

*Primary Examiner* — Kyung Lee
(74) *Attorney, Agent, or Firm* — Rankin, Hill & Clark LLP

(57) ABSTRACT

Provided is a non-linear resistive element which improves the degree of freedom of design of its mounting space. A ceramic sheet 10 which constitutes the non-linear resistive element is configured by a plurality of ceramic pieces 11 being consolidated in a plate like form by an insulating resin 12. One or a plurality of ceramic pieces 11 configure each of a plurality of conductive paths which penetrate the ceramic sheet 10 in a thickness direction thereof, and the ceramic pieces 11 which configure both ends of the conductive paths partially projects from the insulating resin 12.

4 Claims, 4 Drawing Sheets

(51) Int. Cl.

| | |
|---|---|
| ***H01C 7/10*** | (2006.01) |
| ***H01C 7/102*** | (2006.01) |
| *H01C 7/112* | (2006.01) |

(56) References Cited

U.S. PATENT DOCUMENTS

| | | | | | |
|---|---|---|---|---|---|
| 5,262,754 | A | * | 11/1993 | Collins | 338/21 |
| 5,519,564 | A | * | 5/1996 | Carpenter, Jr. | 361/127 |
| 6,055,147 | A | * | 4/2000 | Jeffries et al. | 361/103 |
| 6,711,807 | B2 | * | 3/2004 | Duggal et al. | 29/614 |
| 6,794,980 | B2 | * | 9/2004 | Chu et al. | 338/22 R |
| 2001/0045934 | A1 | | 11/2001 | Turner et al. | |
| 2008/0295949 | A1 | * | 12/2008 | Sakurai et al. | 156/89.12 |

FOREIGN PATENT DOCUMENTS

| | | |
|---|---|---|
| JP | 02-062005 | 3/1990 |
| JP | 2003-059705 | 2/2003 |
| JP | 2008-218749 | 9/2008 |
| WO | 2012/046765 | 4/2012 |

* cited by examiner

NON-LINEAR RESISTIVE ELEMENT

TECHNICAL FIELD

The present invention relates to a non-linear resistive element that is used for an overvoltage protector, for example, a surge arrester, a surge absorber element or a voltage stabilizing element.

BACKGROUND ART

Non-linear resistive elements generally called a varistor show a characteristic of a resistance value thereof varying with a voltage applied thereto, i.e., have a non-linear voltage-current characteristic such that the element has a high resistance value showing an insulating characteristic when a normal voltage is applied thereto, while showing a low resistance value when an abnormal high voltage is applied thereto. Non-linear resistive elements having such characteristic are broadly utilized in a surge arrester or a surge absorber for the purpose of absorbing surge and noise, or in a voltage stabilizing element.

The non-linear resistive element is, for example, composed of ceramic sintered compact having zinc oxide (ZnO) as a primary component. The ceramic sintered compact is obtained by molding a powder including zinc oxide, at least one of a bismuth oxide, antimony oxide, and cobalt oxide as basic additive to develop a non-linear voltage-current characteristic, and various types of oxide added to further increase the performance, and by sintering the compact (green body).

The ceramic sintered compact is, for example, formed as a rectangular plate shape, circular shape, or in various shapes in accordance with the place it is mounted or the shape of a member which becomes the electrode (Patent Document 1 and Patent Document 2).

PRIOR ART DOCUMENTS

Patent Documents

Patent Document 1: Japanese Patent Application Laid-Open No. 2003-59705

Patent Document 2: Japanese Patent Application Laid-Open No. S62-287584

SUMMARY OF THE INVENTION

Problem to be Solved by the Invention

However, according to the shape and size of the ceramic sintered compact, the shape and volume of the space to mount the non-linear resistive element is limited.

As such, the problem to be solved by the present invention is to provide a non-linear resistive element which is able to increase the degree of freedom of design of the mounting space.

Means for Solving the Problem

A non-linear resistive element of the present invention comprises at least a ceramic sheet configured by a plurality of ceramic pieces composed of ceramic sintered compact being consolidated in a plate like shape by an insulating resin, wherein one or a plurality of the ceramic pieces configure each of a plurality of conduction paths which penetrate the ceramic sheet in a thickness direction thereof, and the ceramic pieces configuring both ends of the conduction paths are partially projected from the insulating resin.

According to the non-linear resistive element of the present invention, it is preferable that a projecting part of the ceramic piece with respect to the insulating resin has a convex surface shape. That is, it is preferable that a part of or all of a projecting part surface has a shape in which an approximately center part thereof is higher than other parts such as an approximately spherical surface shape or approximately elliptically spherical surface shape, or the like.

According to the non-linear resistive element of the present invention, it is preferable to further comprise a conductive layer which covers one of or both of a pair of main faces of the ceramic sheet.

According to the non-linear resistive element of the present invention, preferably, it is configured such that a ceramic piece layer composed of a plurality of the ceramic pieces arranged in parallel with respect to a main face of the ceramic sheet is bound by the insulating resin in a state laminated in the thickness direction of the ceramic sheet.

According to the non-linear resistive element of the present invention, it is preferable that the non-linear resistive element is configured such that a plurality of the ceramic sheets and a conductive layer are alternately laminated.

Effect of the Invention

According to the non-linear resistive element of the present invention, the insulating resin is made thinner for the amount secured by a projecting amount of the ceramic pieces with respect to the insulating resin, thereby ensuring flexibility of the ceramic sheet. By this, it is able to easily deform the non-linear resistive element according to a space of an arbitrary shape and volume. Moreover, the ceramic sheet is cut by an appropriate tool at the part of insulating resin. Therefore the shape and size thereof are easily adjusted. As a result of these, it is able to increase the degree of freedom of design of the shape and size of the mounting space.

In addition, in a case the ceramic sheet is deformed along a surface of a conductor configuring an electrode or a terminal of the non-linear resistive element, it is able to surely make the projecting part of the ceramic pieces contact with respect to the conductor. By doing so, electric contact between the ceramic pieces configuring one end or both ends of the conduction paths which penetrates the ceramic sheet and the conductor is surely realized.

MODE FOR CARRYING OUT THE INVENTION

First Embodiment

Configuration

Figure 1:
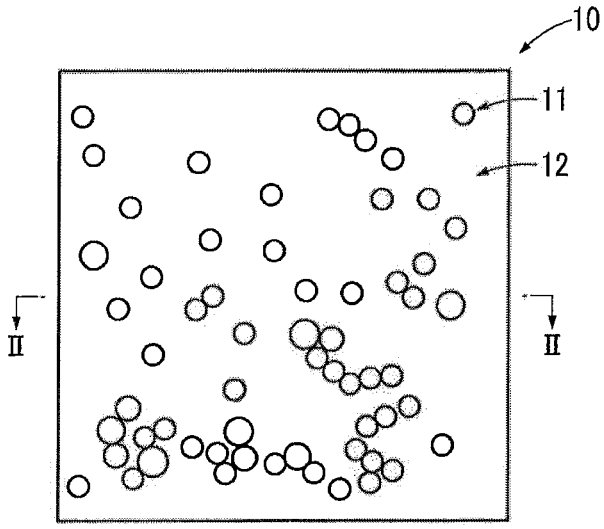
FIG. 1 is a top view of a ceramic sheet configuring a non-linear resistive element of a first embodiment of the present invention.

A non-linear resistive element as the first embodiment of the present invention comprises a ceramic sheet 10 as shown in FIG. 1. The ceramic sheet 10 is configured such that a plurality of ceramic pieces 11 (or ceramic beads) composed of ceramic sintered compact and having an approximately spherical shape are in a state decentrally arranged in an approximately planar shape, and are consolidated (formed, bound, gathered) in an approximately plate shape by an insulating resin 12. In the example shown in FIG. 1, plurality of the ceramic pieces 11 are arranged randomly, but they may be arranged with regularity. The shape of the ceramic sheet 10 is not limited to a rectangular shape and can be arbitrarily changed to a circular shape or the like according to the intended use.

The ceramic pieces 11 may be formed in an arbitrary shape such as an oval sphere shape, a column shape such as a circular columnar shape or the like, a tubular shape such as a cylinder shape or the like, a frustum shape such as a circular truncated cone, or a rectangular parallelepiped shape or a polyhedral shape such as a regular dodecahedron or the like, in addition to the approximately spherical shape. The ceramic pieces 11 are configured of ceramic sintered compact having electric resistance characteristics of non-linearity and having zinc oxide (ZnO), strontium titanate ($SrTiO_3$), silicon carbide (SiC), tin oxide ($SnO_2$), and the like as main components. $Bi_2O_3$, $Pr_6O_{11}$, $BaTiO_3$, $SrTiO_3$, $TiO_2$, $SnO_2$, or $Fe_3O_4$, or the like may be selected as an addition ingredient to the main oxidant component.

As the insulating resin 12, various resins may be used which have both insulation property and flexibility according to the intended use such as synthetic resin i.e. fluorine based resin, silicone based resin, urethane based elastomer, or olefin based elastomer, or the like. The insulating resin 12 may be a resin whose flexibility becomes obvious at a certain constant temperature range different from the ambient temperature.

By using a resin having superior fire retardance, thermal resistance, and thermal conductivity as the insulating resin 12, enhancement of thermal property and improvement of electric performance are attained. The insulating resin 12 may contain additive filler for improving its fire retardance, thermal resistance, or thermal conductivity. As the additive substance, in addition to oxides such as alumina or non-oxides such as aluminum nitride or boron nitride, thermal conductive particles whose surfaces are insulation processed (which may be either metal or non-metal compound), and in some cases, a small amount of conductive particles within a range that the insulating property does not degrade may be used.

By using resins having a property of changing colors by heating as the insulating resin 12, it becomes possible to visually confirm whether or not a surge voltage is applied or the degree of element deterioration. Therefore, it is meaningful from the point of determining whether or not it is necessary to change the ceramic sheet 10. In this case, it becomes even easier to visually confirm if the electrode layer 13 of both surfaces of the element are transparent electrodes such as ITO (indium tin oxide) or the like formed by physical methods such as vapor deposition or sputtering or the like.

Figure 2:
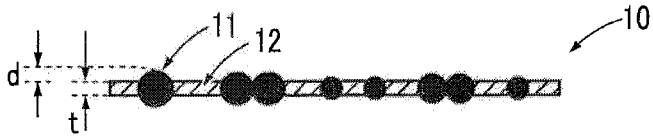
FIG. 2 is a cross-sectional view of II-II line of FIG. 1.

As is shown in FIG. 2, each ceramic piece 11 configures each conductive path penetrating the ceramic sheet 10 in its thickness direction (up-down direction in the figure), and the ceramic pieces 11 configuring the both ends of each conductive path are partially projected from the insulating resin 12. The projecting parts of the ceramic pieces 11 are approximately spherical surface shape (convex surface shape) in which an approximately center portion is high. It is not necessary that the ceramic pieces 11 are spaced from each other in a direction parallel to the main face of the ceramic sheet 10, and may be in contact so as to configure electrical contact.

Figure 3:
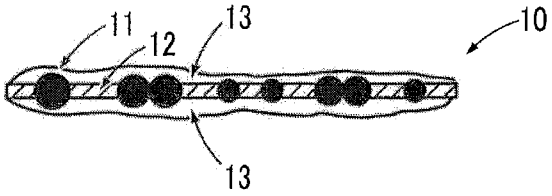
FIG. 3 is an explanatory view showing a configuration of the non-linear resistive element comprising the ceramic sheet and a conductive layer covering both main faces thereof.

As is shown in FIG. 3, the non-linear resistive element may include a pair of electrode layers (conductive layers) 13 covering each of a pair of main faces of the ceramic sheet 10. Only one of the main faces of the ceramic sheet 10 may be covered by the electrode layer 13. Moreover, the non-linear resistive element may include an insulating resin layer or an insulating resin body which protects the outer side of the electrode layer 13.

Manufacturing Method

For manufacturing the ceramic piece 11, for example, $Bi_2O_3$: 0.5 mol %, $Sb_2O_3$: 1.0 mol %, $Co_2O_3$: 0.5 mol %, $MnO_2$: 0.5 mol %, $Cr_2O_3$: 0.5 mol % and $Al(NO_3).9H_2O$: 0.01 mol % are added to ZnO powder as a primary component. Furthermore, solvent and dispersant are added and mixed, and thereby the slurry is prepared.

This slurry is contained in an appropriate container, and together with ammonium alginate aqueous solution contained in another container, is dropped into dilute nitric acid aqueous solution in which metallic zinc is dissolved, through a common nozzle. The ammonium alginate aqueous solution becomes a gel in the dilute nitric in which metallic zinc is dissolved, and congeals into a jelly state. Therefore, the approximately spherical shaped compact covered with the jelly is obtained. The ammonium alginate aqueous solution may be directly added to the slurry. The combination of the solution and the substance which congeals in a jelly state in the solution may be appropriately changed.

The size of the compact, and thus the ceramic piece 11 can be adjusted according to an amount of drop per time. The concentration of the ammonium alginate aqueous solution and the concentration of the metallic zinc in the dilute nitric acid aqueous solution are appropriately adjusted. In place of granulated powder, a pulverized powder obtained by pulverization after calcination of the ceramic compact may be used. By filling and molding the granulated powder in a mold cavity of an appropriate shape, the compact of an arbitrary shape such as substantially spherical shape, oval sphere shape, a circular columnar shape, prismatic shape, circular truncated cone, or a polyhedral shape, or the like, may be formed.

After the compact is dried, the compact is sintered thereby manufacturing an approximately spherical shape ceramic sintered compact as the ceramic piece 11. For example, if it is a ceramics of ZnO system, the compact is sintered for 2 hours at 1,100° C. In order to prevent the compact from becoming a flattened shape during drying, the compact dried to a certain degree may be rotated while being dried.

An average diameter r of the approximately spherical shape ceramic piece 11 is adjusted to be included in a range of, for example, 0.2 to 5 mm. In a case the ceramic piece 11 is too small, it becomes difficult to form, whereas in a case the ceramic piece 11 is too large, it becomes easier to cause non-uniformity of composition and microstructure of the ceramic piece 11.

The ceramic piece 11 is kneaded with the insulating resin 12 in a molten state, and by extrusion molding in a sheet form, the ceramic sheet 10 of the above constitution is manufactured. By adjusting the composition ratio of the ceramic piece 11 and the insulating resin 12, the density (the number of ceramic pieces 11 per unit area of the ceramic sheet 10) or the average interval of the ceramic pieces 11 is adjusted. As a result, electric characteristic such as electrostatic capacitance and its frequency characteristic, heat release characteristic, and mechanical strength or the like, in addition to the basic performance such as nonlinearity of the resistance, energy withstand capacity, and aging characteristic or the like of the non-linear resistive element can be controlled.

The ceramic sheet 10 may be manufactured according to injection molding in place of extrusion molding. More specifically, the insulating resin 12 in a molten state is injected into the mold in a state in which plurality of the ceramic pieces 11 are fixed in a predetermined arrangement pattern inside the mold cavity. For example, by using a mounting machine for a small size electronic component, the ceramic pieces 11 can be fixed to predetermined places by the resist as the insulating adhesive (portions other than the predetermined places are removed by photo-etching). By doing so, the space between plurality of the ceramic pieces 11 are filled with the insulating resin, and as a result, a ceramic sheet of the similar configuration is obtained.

In a case the ceramic piece 11 near the main face of the ceramic sheet 10 is covered by the insulating resin 12, in order to expose the same, sandblasting processing may be applied to the main face of the ceramic sheet 10, or the covering portion may be dissolved by an appropriate solution and then removed. The type of the insulating resin 12 may be selected from the view point of removing the covering.

Conductive paste including silver particles and thermoplastic resin is applied to or printed on both main faces of the ceramic sheet 10 in a predetermined pattern, and then by drying it, an electrode layer 13 is formed. Room temperature curing type conductive adhesive or thermal curing-type conductive adhesive may be used as the paste. Moreover, other than silver, copper, gold, or carbon or the like may be used as the conductive particle. The electrode layer 13 may be formed by chemical method such as plating or the like, physical method such as vapor deposition or sputtering or the like, or application and burning of nano-sized silver particles.

From the view point to prevent thermal runaway of the non-linear resistive element, as the adhesive configuring the electrode layer 13, a resin having a fuse function so as to sharply increase the resistance with the raise of temperature may be used. Other than providing the fuse function to the electrode layer 13, a layer formed of small sintered body pieces of a positive characteristic thermistor (PTC thermistor) may be bonded to one of or both of the main faces of the non-linear resistive element on the outer side of the electrode layer 13.

In place of configuring the electrode layer 13, a conductive plate material may be fixed to the ceramic sheet 10 by an adhesive or a bolt or the like so as to contact with respect to the ceramic piece 11.

At least one of the both main faces of a single ceramic sheet 10 may be provided with a plurality of electrode layers 13 mutually spaced. In such case, the interval of a plurality of the electrode layers 13 is adjusted so as to prevent electric short by the insulating resin 12. More specifically, an interval of a boundary region or an intermediate region which spaces the ceramic piece groups (to which one or a plurality of the ceramic pieces 11 belongs) from each other having electric contact with respect to each of a plurality of the electrode layers 13, is adjusted.

In order to ensure electric insulation at the boundary region, the occupied volume rate of the ceramic pieces 11 in the boundary region may be adjusted to be lower than the occupied volume rate of the ceramic piece group in the ceramic sheet 10. By doing so, a multi-terminal non-linear resistive element in which each electrode layer 13 being an electrode terminal, may be configured.

Second Embodiment

Configuration

Figure 4A:
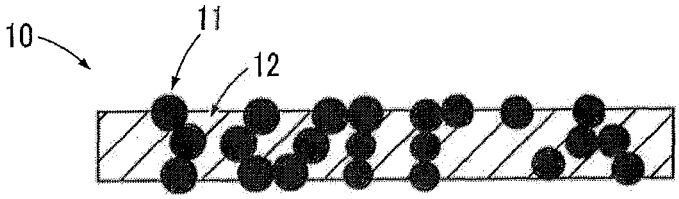
FIG. 4A and FIG. 4B are explanatory views related to a modification of the non-linear resistive element as the first embodiment of the present invention.
Figure 4B:
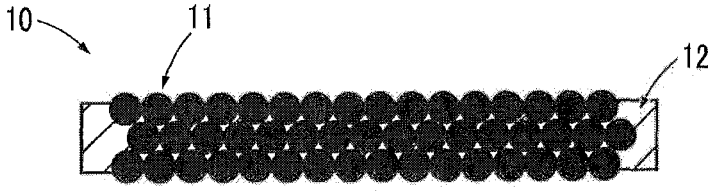

As is shown in FIG. 4A, a ceramic sheet 10 configuring a non-linear resistive element as the second embodiment of the present invention is configured by three ceramic piece layers composed of a plurality of ceramic pieces 11 arranged in parallel with respect to a main face of the ceramic sheet 10, being in a state laminated and consolidated (formed, bound, gathered) by an insulating resin 12. As a modification, as schematically shown in FIG. 4B (the cross-sectional diameter of the ceramic pieces 11 in a cross-sectional view differs in every other layer), a plurality of the ceramic pieces 11 which have an approximately spherical shape and the same diameter, may be formed like a sheet by the insulating resin 12 in a state arranged to have a three-dimensional closest packing structure.

In such case, conductive paths are configured by not a single ceramic piece 11, but by a plurality of the ceramic pieces 11 contacting each other in a thickness direction of the ceramic sheet 10.

The manufacturing method of the ceramic sheet 10 of the second embodiment is the same as the manufacturing method of the ceramic sheet 10 of the first embodiment. Therefore, the explanation will be abbreviated.

Another Embodiment of the Present Invention

It is acceptable that in a part of a region of the ceramic sheet 10, a conductive path is configured by a single ceramic piece 11 as in the first embodiment (refer to FIG. 2), and in other regions, the conductive path is configured by a plurality of the ceramic pieces 11 contacting each other in the thickness direction of the ceramic sheet 10 as in the second embodiment (refer to FIG. 4).

The ceramic sheet 10 may be sectioned to a plurality of regions in which an existence density of the conductive paths differs (number of conductive paths per unit area of the ceramic sheet 10. In the first embodiment, it is equal to the existence density of the ceramic piece 11). For example, the ceramic sheet 10 may be configured such that an existence density N1 of the conductive path in a first region of the ceramic sheet 10 is higher than an existence density N2 of the conductive path in a second region adjacent to the first region.

A part corresponding to the first region is formed according to the extrusion molding method by the insulating resin 12 in a state the ceramic pieces 11 are mixed at a first ratio, and then a part corresponding to the second region is formed also according to the extrusion molding method by the insulating resin 12 in a state the ceramic pieces 11 are mixed in a second ratio lower than the first ratio. By doing so, the ceramic sheet 10 of the above configuration in which the existence density of conductive paths is sparse and dense is manufactured.

A single non-linear resistive element may be configured by alternately laminating a plurality of ceramic sheets 10 configuring the non-linear resistive element as one or both of the first embodiment and the second embodiment of the present invention, and one or a plurality of conductive layers, in the thickness direction of the ceramic sheet 10.

Effect of the Non-Linear Resistive Element of the Present Invention

Figure 5A:
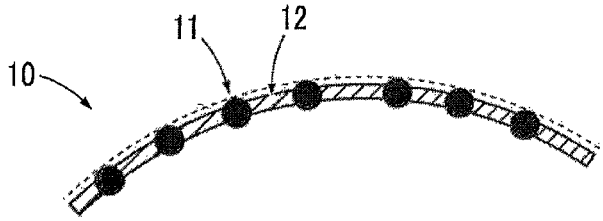
FIG. 5A, FIG. 5B, and FIG. 5C are explanatory views of a configuration of a ceramic sheet configuring a non-linear resistive element as a second embodiment of the present invention.
Figure 5B:
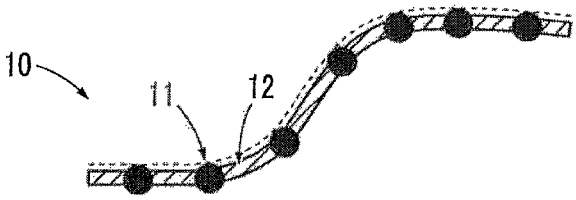
Figure 5C:
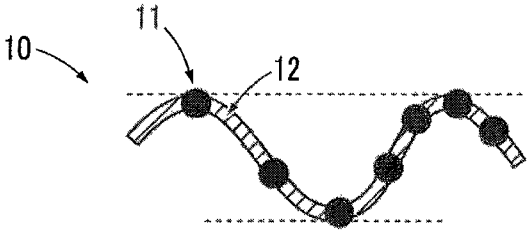

According to the non-linear resistive element of the present invention of the aforementioned configuration, as for the amount ensured by the projecting amount of the ceramic piece 11 with respect to the insulating resin 11, the insulating resin 12 is made thinner, thereby the flexibility of the ceramic sheet 10 is ensured. By doing so, for example, as shown in FIG. 5A to FIG. 5C, it is able to easily deform the shape of the ceramic sheet 10 configuring the non-linear resistive element as the first embodiment of the present invention (refer to FIG. 2), and thus the non-linear resistive element, in accordance with a space of an arbitrary shape and volume.

Figure 6:
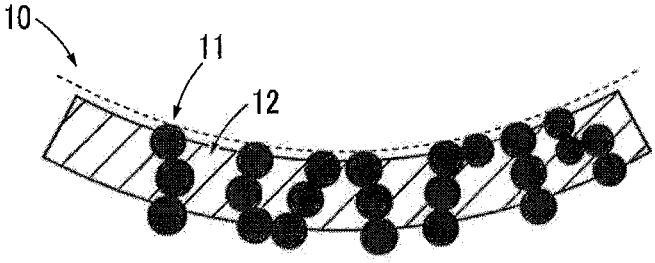
FIG. 6 is an explanatory view related to a modification of the non-linear resistive element as the second embodiment of the present invention.

Similarly, as shown in FIG. 6, the ceramic sheet 10 configuring the non-linear resistive element of the second embodiment of the present invention (refer to FIG. 4A), and thus the non-linear resistive element, can be easily deformed. In the second embodiment, although the thickness t of the insulating resin 12 is larger compared to the first embodiment, by adjusting the density of the ceramic piece 11 or the number of ceramic piece layers, in addition to the material of the insulating resin 12, sufficient flexibility according to the intended use of the ceramic sheet 10 can be obtained.

Even when the electrode layer 13 is provided on one or both of the main faces of the ceramic sheet 10 (refer to FIG. 3), the same applies as long as the flexibility thereof is ensured. Moreover, the ceramic sheet 10 is cut by an appropriate tool such as scissors or cutters or the like, at the part of the insulating resin 12. Therefore, its shape and size are easily adjusted.

As a result, it is able to increase the degree of freedom of design of the shape and size of the mounting space of the non-linear resistive element having the ceramic sheet 10 as its composing element.

In a case the ceramic sheet 10 is deformed so as to follow along a surface of the conductor (which may be connected to a surge arrester rod or grounded) as the electrode of the non-linear resistive element, it is able to make the projecting part of the ceramic pieces 11 surely contact the conductor. This is a significant effect in a case where the ceramic piece 11 is approximately spherical shape, oval sphere shape, or a polyhedral shape such as a dotriacontahedron or the like, and the projecting part of the ceramic piece 11 with respect to the insulating resin 12 is a substantially isotropic convex shape.

For example, in a case where the ceramic sheet 10 is deformed so as to follow along a surface of the conductor as the electrode of the non-linear resistive element as the first embodiment of the present invention (refer to FIG. 5A to FIG. 5C and the dashed line of FIG. 6), it is able to make the projecting part of the ceramic pieces 11 surely contact with respect the conductor (refer to FIG. 5A to FIG. 5C and FIG. 6).

The operation to make the ceramic sheet 10 contact or mounted to the conductor may be performed at the manufacturing stage of the non-linear resistive element at the factory, or may be performed at the configuration or mounting state of the non-linear resistive element at a place where the conductor serving the electrode function is provided.

By this, electric contact between the ceramic pieces 11 configuring one end or both ends of the conduction path which penetrates the ceramic sheet 10 and the conductor is surely realized. As a result, it is able to improve the degree of freedom of design of the non-linear resistive element having the ceramic sheet of the present invention as its composing element and the mounting space thereof

EXPLANATION OF REFERENCE SIGNS

10 . . . ceramic sheet, 11 . . . ceramic piece, 12 . . . insulating resin, 13 . . . electrode layer (conductive layer)

The invention claimed is:

1. A non-linear resistive element, comprising:

at least a ceramic sheet formed by a plurality of ceramic pieces composed of ceramic sintered compact being consolidated in a plate like shape by an insulating resin, and a conductive layer which covers at least one of a pair of main faces of the ceramic sheet, wherein one or a plurality of the ceramic pieces form each of a plurality of conductive paths which penetrate the ceramic sheet in a thickness direction thereof, and the ceramic pieces forming both ends of the conductive paths are partially projected from the insulating resin, and a projecting part of the ceramic pieces with respect to the insulating resin is an isotropic convex shape.

2. The non-linear resistive element according to claim 1, wherein the non-linear resistive element is configured such that a ceramic piece layer composed of a plurality of the ceramic pieces arranged in parallel with respect to a main surface of the ceramic sheet, is bound by the insulating resin in a state laminated in the thickness direction of the ceramic sheet.

3. The non-linear resistive element according to claim 1, wherein the non-linear resistive element is configured such that a plurality of the ceramic sheets and a conductive layer are alternately laminated.

4. The non-linear resistive element according to claim 1, wherein the ceramic pieces have a spherical shape or an oval spherical shape.

* * * * *